US011326331B1

(12) United States Patent
Coakley

(10) Patent No.: US 11,326,331 B1
(45) Date of Patent: May 10, 2022

(54) SMART SELF-CLEANING BATHROOM

(71) Applicant: Eraina Shanel Coakley, Lewisville, TX (US)

(72) Inventor: Eraina Shanel Coakley, Lewisville, TX (US)

( * ) Notice: Subject to any disclaimer, the term of this patent is extended or adjusted under 35 U.S.C. 154(b) by 18 days.

(21) Appl. No.: 16/839,754

(22) Filed: Apr. 3, 2020

(51) Int. Cl.
*E03D 9/00* (2006.01)
*A47K 13/30* (2006.01)

(52) U.S. Cl.
CPC ..... *E03D 9/002* (2013.01); *A47K 13/302* (2013.01)

(58) Field of Classification Search
CPC ..... A47K 13/30–307; A47K 4/00; A47L 5/38; A47L 7/0047; E03D 9/002; E04H 1/1216; E04H 1/1277
See application file for complete search history.

(56) References Cited

U.S. PATENT DOCUMENTS 1,741,622 A * 12/1929 Grafani ..... A47K 13/302 4/233
3,969,133 A * 7/1976 McTighe ..... E03D 9/002 134/21
4,233,692 A * 11/1980 Sinsley ..... A47K 4/00 4/662
5,368,651 A * 11/1994 Esser ..... A61L 2/22 134/169 R
5,647,074 A * 7/1997 White, Jr. ..... E03D 9/002 4/312
9,375,121 B2 * 6/2016 Coesel ..... A47L 9/248
10,006,192 B2 * 6/2018 Arnott ..... A47L 11/4088
10,709,308 B2 * 7/2020 Buehler ..... A47L 11/4016
2006/0021121 A1 * 2/2006 Moussa ..... A47K 13/302 4/233
2009/0007328 A1 * 1/2009 Feltri ..... E04H 1/1216 4/662
2017/0283092 A1 * 10/2017 Brown ..... B64F 5/30
2019/0087788 A1 * 3/2019 Murphy ..... A47K 13/105
2020/0217057 A1 * 7/2020 Spiro ..... G08B 21/245

* cited by examiner

*Primary Examiner* — David P Angwin
*Assistant Examiner* — Nicholas A Ros
(74) *Attorney, Agent, or Firm* — Jeffrey C. Watson; Grell & Watson Patent Attorneys LLC

(57) ABSTRACT

The Coakley Smart Self-Cleaning Bathroom is designed to quickly, efficiently, and safely clean and disinfect bathrooms. This technology can significantly benefit businesses (including restaurants, hotels, etc.), hospitals, airplanes, trains, residences, etc. It would eliminate manual labor in bathroom cleaning, saving time and resources; the technology would also be more efficient in cleaning than a human. Finally, safety features would be implemented to ensure the safety of humans in the proximity.

5 Claims, 5 Drawing Sheets

SMART SELF-CLEANING BATHROOM

BACKGROUND

1. Field of the Invention

The present invention relates generally to cleaning systems, and more specifically, to a self-cleaning bathroom system that enables the automated removal or debris, bacteria and other similar foreign matter within a confined space.

2. Description of Related Art

Cleaning systems are well known in the art and effective means to sanitize, organize or otherwise presentable or habitable. Commonly, businesses, organizations, vehicles that contain a bathroom and residences need a way to regularly maintain the bathroom clean. In regard to bathrooms clean includes, disinfected, trash removed surfaces free from marks or prints and the supplies replenished. Additionally, the cleaning should be fast and efficient as the bathroom is generally in demand. These needs are particularly essential for busy businesses, organizations, and hospitals.

One of the problems commonly associated with common cleaning systems is its limited efficiency. For example, in a manual format, each surface in the bathroom must be wiped, scrubbed brushed or swept in order to properly clean it. This takes time and attention to detail to accomplish properly. The time for this labor is commonly not paid well reducing the willingness for workers to perform these tasks. This results in a great need to maintain a clean bathroom and a limited ability to do so.

Accordingly, although great strides have been made in the area of cleaning systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
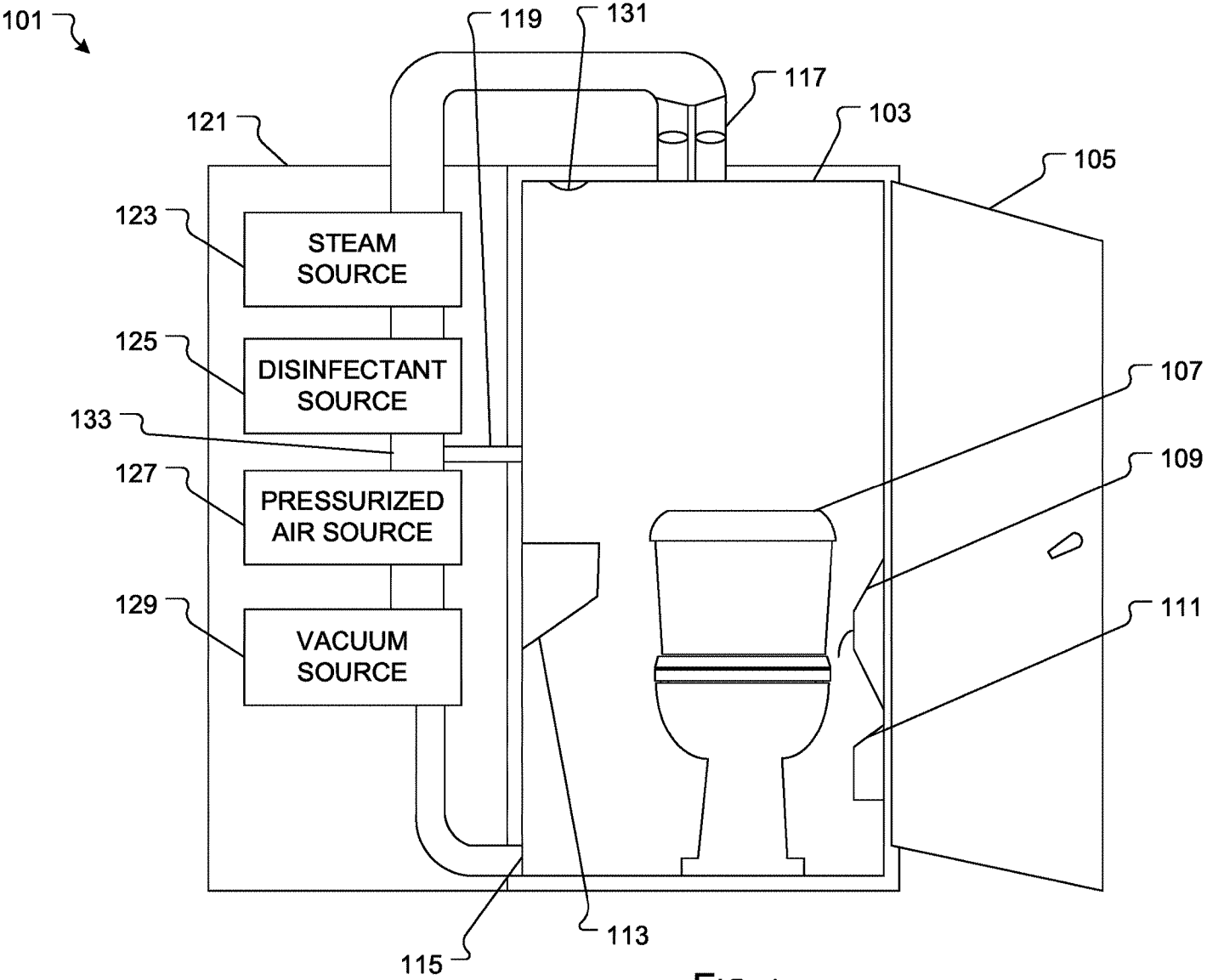
FIG. 1 is a front view of a self-cleaning bathroom system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional cleaning systems. Specifically, the invention of the present application provides means of cleaning that eliminates the majority of the manual labor, is fast and efficient, and promotes a healthier environment through disinfection. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a front view of a stationary or portable self-cleaning bathroom system in accordance with a preferred embodiment of the present application. It will be appreciated that system 101 overcomes one or more of the above-listed problems commonly associated with conventional cleaning systems.

In the contemplated embodiment, system 101 includes a space 103 that serves as a bathroom that is sealed by a door 105 so that fluids are not able to enter or exit the space thereby when closed. As a bathroom, the space 103 includes a toilet 107 a toilet paper dispenser 109 a trash receptacle 111 and a sink 113. In the present embodiment, each of these is waterproof and automated to facilitate the cleaning of the space 103 and the use thereof. The space 103 further includes a vent 117 near the top thereof and a drain 115 near the bottom thereof or in the floor thereof to facilitate the movement of fluid in and out of the space and other debris out of the space 103. A sensor 131 is configured to detect the cleanliness of the space, a person or other being in the space and the status of the process of cleaning the space 103. Inlets 119 for the injection of fluids into the space 103 are also included. In a separate cabinet 121 are a steam source 123, a disinfectant source 125, a pressurized air source 127 and a vacuum source 129 all in fluid communication with the space 103 via tubes 133, pipe or the like.

While it is depicted that the system 101 includes a steam source 123, a disinfectant source 125, a pressurized air source 127 and a vacuum source 129 it is contemplated that system 101 could function without one or more of these and not deviate from the intent of the application. For example, an alternative embodiment could not include a vacuum source 129 but rely on the pressurized air source 127 to provide enough fluid flow to move debris in the space. Further it is contemplated that the sources could vary in their composition. For example, the steam source 123 could provide high-pressure steam or low-pressure steam and that the volume flow rate could vary.

It is contemplated that the fluid used to clean the space 103 could be captured, filtered, cleaned and otherwise prepared to be used again to clean the space.

Figure 2:
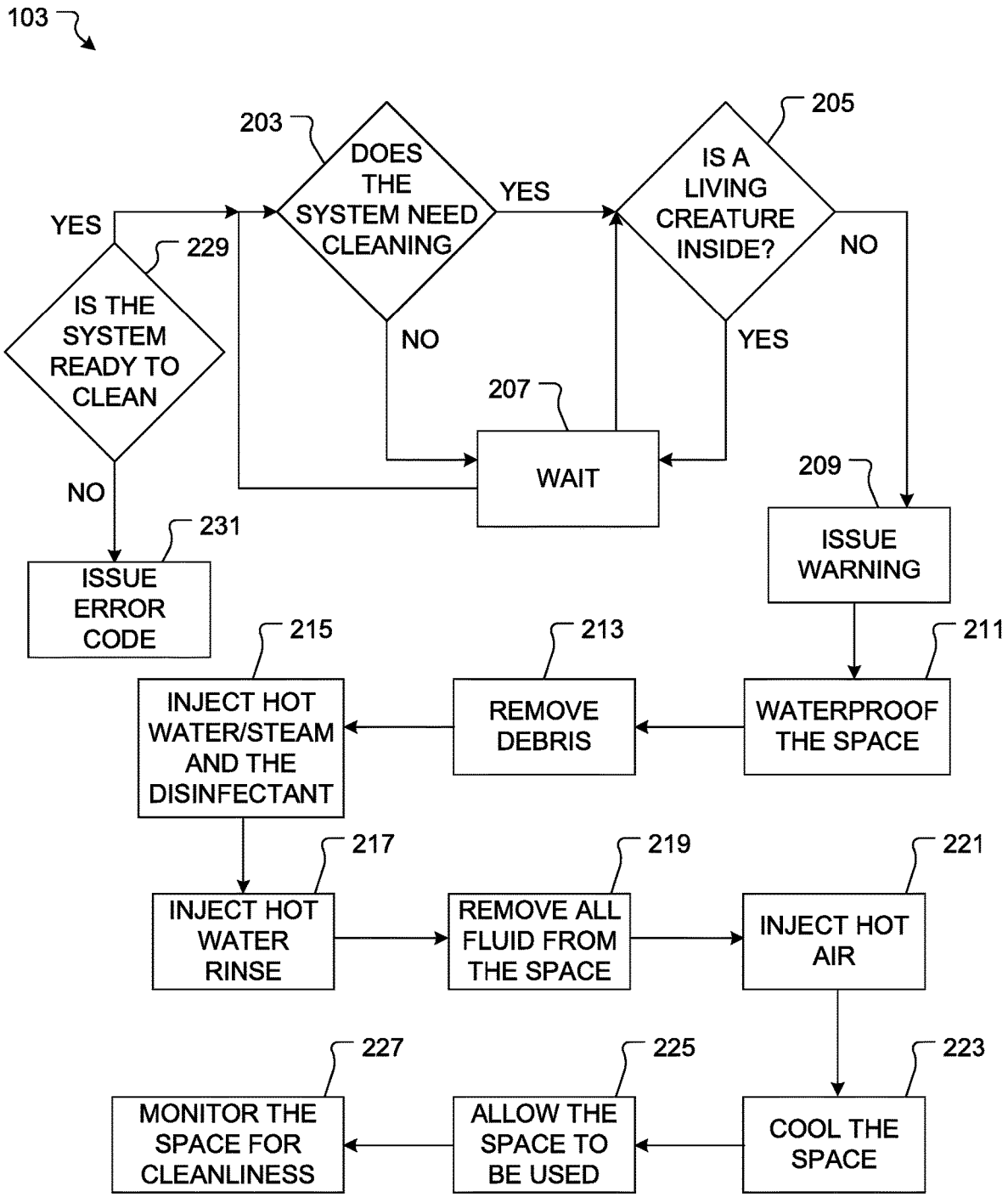
FIG. 2 is a diagram of the system of FIG. 1 in use.

The system 101 is depicted in use in FIG. 2 and it will determine if the system needs to be cleaned 203 and if so determine if there is a living creature inside 205 if the system does not need to be cleaned or if the space is not empty it will wait 207 until both of these conditions are met. When they are met the system 101 will issue a warning 209 such as a noise or light to indicate that system 101 will commence its cleaning. The space is sealed and made waterproof 211 such as closing doors or the like. The debris in the space is removed 213 by the vacuum source 129 or the like. Hot water and disinfectant are injected 215 so that every surface is reached. As needed time will elapse until the space 103 is clean when a hot water rinse is injected 217. All of the fluid is removed from the space 219 in preparation for hot air to be injected 221. The space is then cooled 223 either through the temperature of the air that is injected or other means. When the space 103 is at a habitable temperature the system 101 releases the space 103 back for use 225 and monitors the space for cleanliness 227.

It is contemplated that the system 101 be constructed of stainless steel, porcelain, or another heat and corrosion-resistant material so long as the material would withstand the rapid heating and cooling. Disinfection is accomplished through the use of high-powered, heated water and sodium hypochlorite spray such as bleach water. Other disinfectants could be used like Sodium hypochlorite, which is preferable, but another disinfecting solution may be substituted. Additionally, it is contemplated that heated air could be used to disinfect the bathroom.

It should be appreciated that one of the unique features believed characteristic of the present application is that the waterproof space 103 allows for fluids to be used to clean all of the surfaces therein. It will be appreciated the fluid is supplied from sources as selected to accomplish the cleaning therein.

It is contemplated that safety features would include an operations panel, on/off switch, exterior manual shut-off button, interior and exterior manual locks, and heat-recognizing sensors, which would detect a warm-blooded presence and prevent operation of the system and the resulting injury or death.

It is contemplated that receptacles or other methods of disposal for the debris and the fluids would be provided with the system along with methods of directing the debris and fluid waste thereto.

Figure 3:
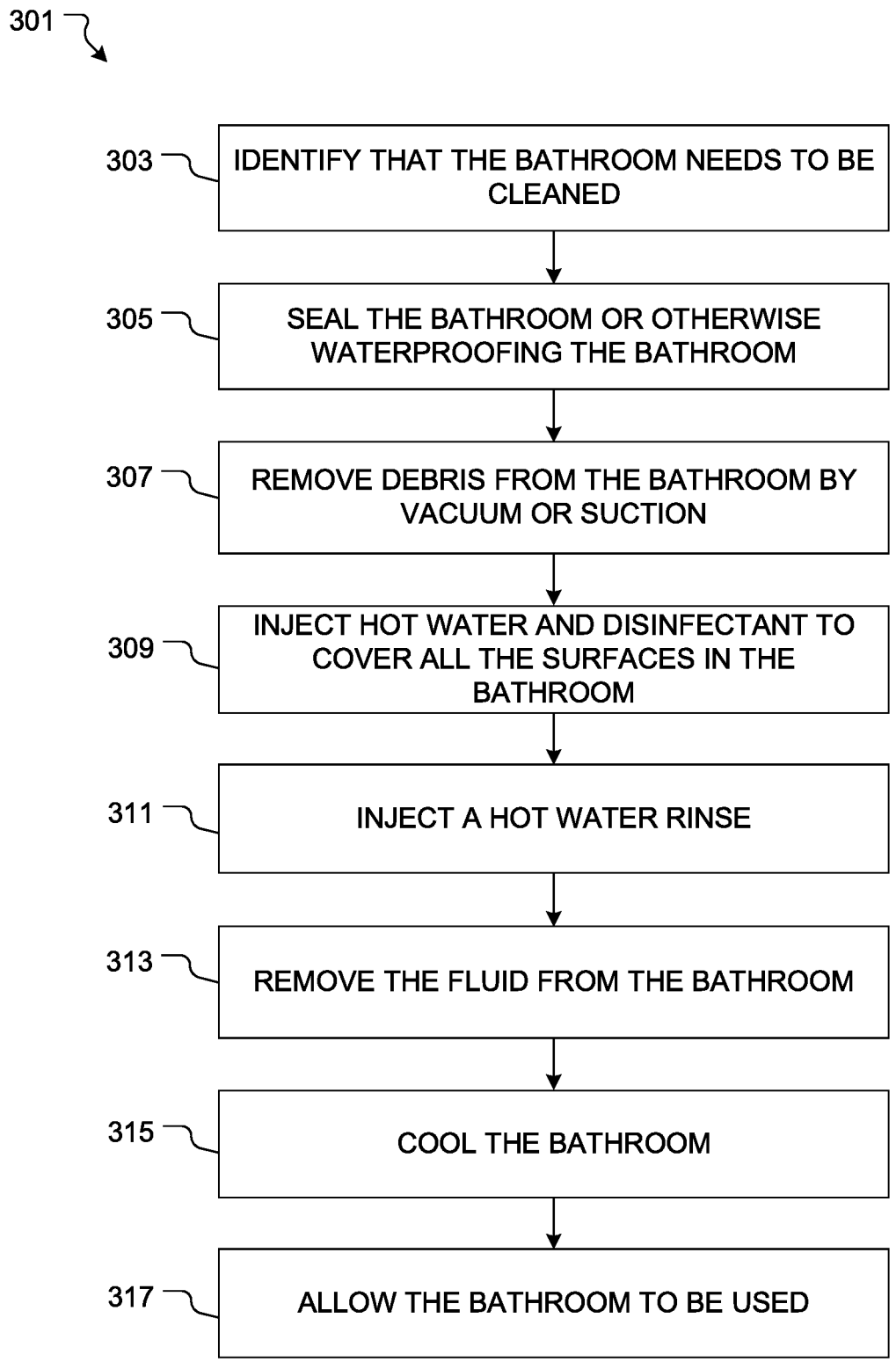
FIG. 3 is a flowchart of a method of cleaning a bathroom.

A method of cleaning a bathroom is depicted by FIG. 3. Method 301 includes identifying that the bathroom needs to be cleaned 303, sealing the bathroom or otherwise waterproofing the bathroom 305, removing debris from the bathroom by vacuum or suction 307, injecting hot water and disinfectant to cover all the surfaces in the bathroom 309, injecting a hot water rinse 311, removing the fluid from the bathroom 313, cooling the bathroom 315 and allowing the bathroom to be used 317.

Figure 4:
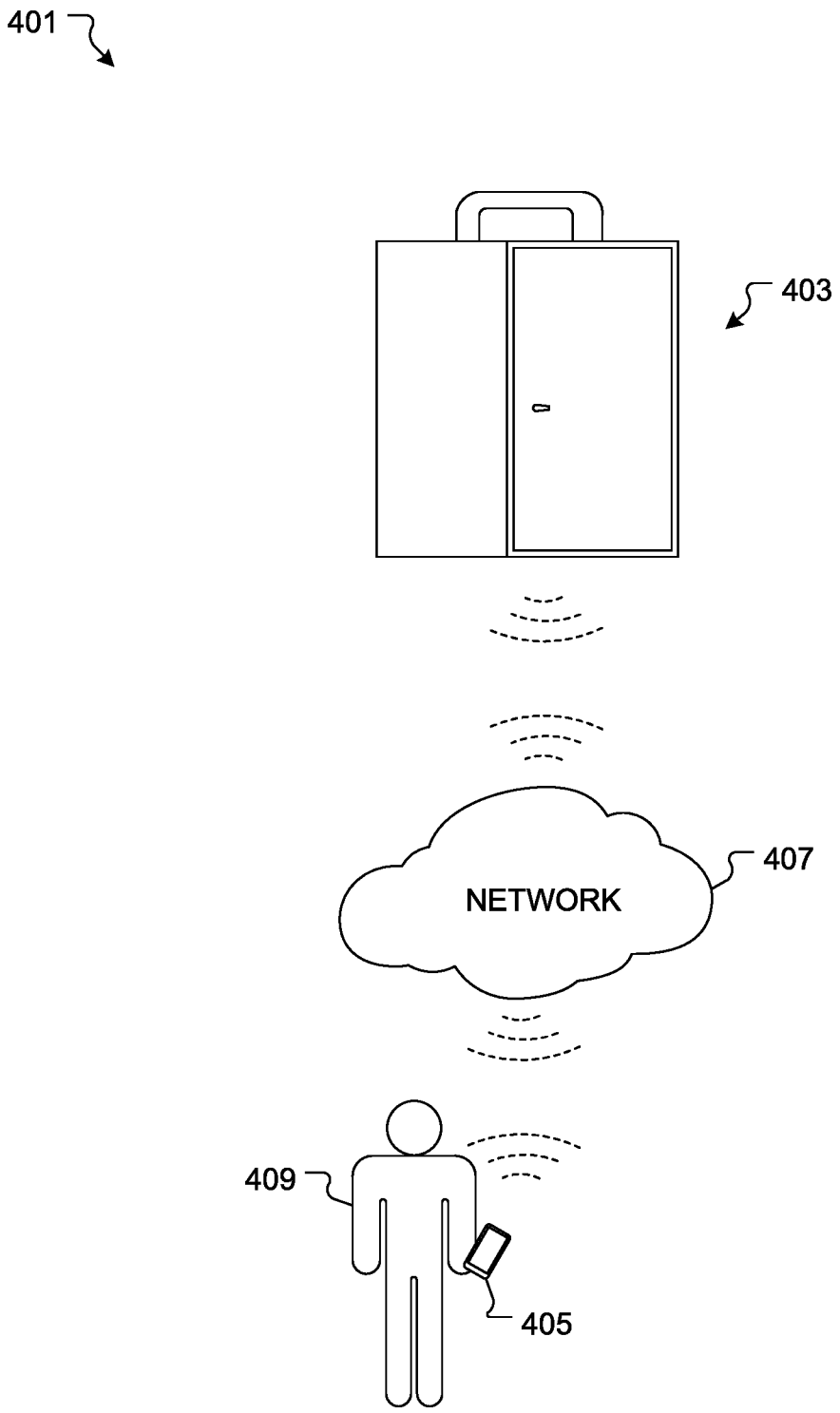
FIG. 4 is a diagram of an alternative embodiment of the system of FIG. 1

Referring now to FIG. 4 an alternative embodiment of system 101 is depicted. Embodiment 401 includes a self-cleaning bathroom system 403 that is configured to communicate digitally with a personal computing device 405 via a network 407. The personal computing device 405 is operated by the user 409 and is configured to operate the self-cleaning bathroom system 403.

Figure 5:
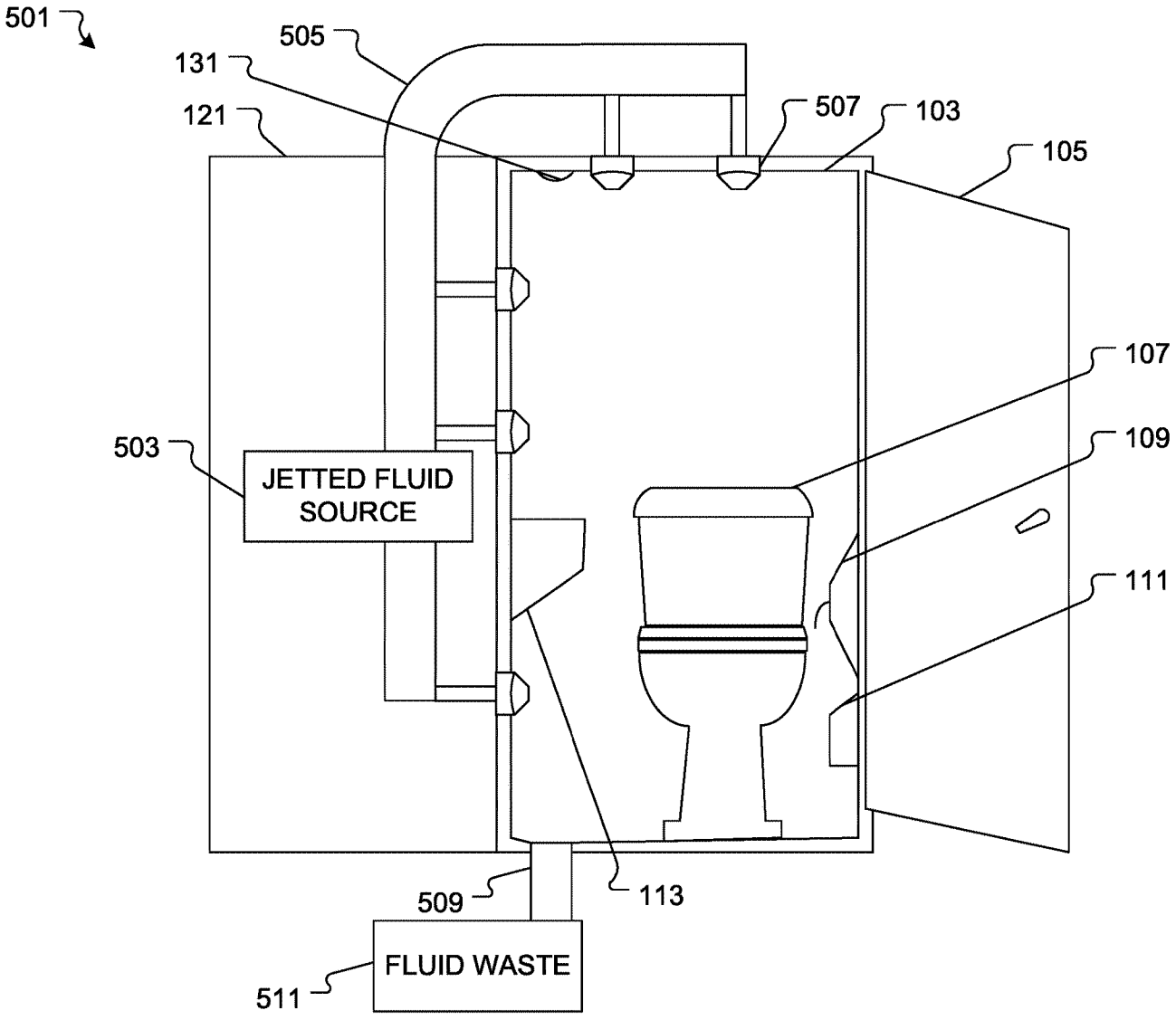
FIG. 5 is a front view of an alternative embodiment of the system of FIG. 1.

Referring now to FIG. 5 an alternative embodiment of the system 101 is depicted. Embodiment 501 includes a jetted fluid source 503. This source could be any fluid that is to be injected into the space 103. The jetted fluid is transported through pipes 505 to a series of jetted nozzles 507. That are located in the top, sides walls or other surfaces of the space and are configured to deliver the jetted fluid into the space 103 at a high pressure and flow rate to forcible clean the space 103. The fluid introduced to the space 103 exits through a drain 509 and travels to a fluid waste 511 management device.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A self-cleaning bathroom system comprising:

at least one space configured to act as a toilet room including a door, a toilet paper dispenser, a trash receptacle, and a sink;

at least one jetted fluid source in fluid communication with the space via a plurality of jetted nozzles along a top and side walls of the space, the at least one jetted fluid source including:

a steam source in communication with the space;

a disinfectant source in communication with the space;

a pressurized air source in communication with the space, the pressurized air source is configured to provide heated air configured to disinfect the space, and air configured to cool the space;

a mechanism to control the introduction of jetted fluid from each of the at least one jetted fluid sources into the space, wherein the at least one jetted fluid source is configured to deliver jetted fluid into the space at a high pressure and flow rate configured to forcibly clean the space; and a vacuum source in communication with the space via a tube connected to a drain in a side wall approximate a floor of the space, the vacuum source is configured to remove debris from the floor of the space via sucking the debris through the drain and into the tube;

wherein the space is configured to be sealed wherein, when activated, the door is configured to seal the space so that fluids are not able to enter or exit the space;

wherein the space is configured to be waterproofed;

wherein the jetted fluid is injected in the space and removed therefrom to clean it;

wherein the steam source, the disinfectant source, the pressurized air source, and the vacuum source are used to clean the space; and wherein the pressurized air source is used to cool the space after cleaning.

2. The system of claim 1 wherein the at least one fluid sources further includes a hot water source.

3. The system of claim 1 wherein the system is configured to detects the presence of a living creature in the space, where the system is configured to prevent activation if the living creature is detected in the space.

4. The system of claim 1 wherein the operation of the system is controlled by a computing device through a network.

5. A method of cleaning a bathroom comprising:

providing the system of claim 1;

identifying that the bathroom needs to be cleaned;

sealing the bathroom or otherwise waterproofing the bathroom;

removing debris from the bathroom by vacuum or suction;

injecting hot water and disinfectant to cover all the surfaces in the bathroom;

injecting a hot water rinse;

removing the fluid from the bathroom;

cooling the bathroom; and allowing the bathroom to be used.

* * * * *